US011390510B2

(12) United States Patent
Secchi et al.

(10) Patent No.: US 11,390,510 B2
(45) Date of Patent: Jul. 19, 2022

(54) CAPPING MACHINE

(71) Applicant: KUMA S.R.L., Bologna (IT)

(72) Inventors: Antonio Secchi, Bologna (IT); Giovanni Fumi, Bologna (IT); Marco Manghi, Bologna (IT)

(73) Assignee: KUMA S.R.L., Bologna (IT)

( * ) Notice: Subject to any disclaimer, the term of this patent is extended or adjusted under 35 U.S.C. 154(b) by 0 days.

(21) Appl. No.: 17/095,283

(22) Filed: Nov. 11, 2020

(65) Prior Publication Data

US 2021/0139304 A1 May 13, 2021

(30) Foreign Application Priority Data

Nov. 11, 2019 (IT) ..... 102019000020730

(51) Int. Cl.
*B67B 3/20* (2006.01)

(52) U.S. Cl.
CPC ..... *B67B 3/2066* (2013.01); *B67B 3/2013* (2013.01)

(58) Field of Classification Search
CPC ..... B67B 3/20; B67B 3/2033; B67B 3/2053; B67B 3/206; B67B 3/2066; B67B 3/2073; B67B 3/2013; B67B 3/28
USPC ..... 53/75, 253, 281, 287, 300, 317, 490
See application file for complete search history.

(56) References Cited

U.S. PATENT DOCUMENTS

2010/0192514 A1* 8/2010 Zanini ..... B67B 3/10 53/303
2012/0017539 A1* 1/2012 Neufeld ..... H02K 41/02 310/12.14
2012/0311963 A1* 12/2012 Fukuda ..... B67B 3/2073 53/317
2015/0375980 A1* 12/2015 Naaber ..... B67B 3/2033 53/317
2017/0073205 A1* 3/2017 Vesentini ..... B67B 3/2053

FOREIGN PATENT DOCUMENTS

EP 2669243 A1 * 5/2013 ..... B67C 3/242
EP 2669243 12/2013
EP 2669243 A1 * 12/2013 ..... B67C 3/242

OTHER PUBLICATIONS

Search Report of Italian Patent Application 102019000020730; dated Aug. 4, 2020.

* cited by examiner

*Primary Examiner* — Andrew M Tecco
*Assistant Examiner* — Jacob A Smith
(74) *Attorney, Agent, or Firm* — Ferguson Case Orr Paterson

(57) ABSTRACT

The present invention relates to a capping machine equipped with a plurality of capping heads with roto-translation movement.

In particular, the present invention relates to a capping head (1) comprising a supporting structure (2) on which a roto-translation system (3) is mounted, operatively connected to a capping device (4), characterized in that the roto-translation system (3) comprises a linear motor (3*a*) and a rotary motor (3*b*) operatively coupled so as to impart a roto-translation motion to the capping device (4) and in that the capping head (1, 201) comprises a suspension system adapted to keep the rotary motor (3*b*) in a raised position even when the linear motor (3*a*) is disconnected or electromagnetically decoupled.

12 Claims, 5 Drawing Sheets

CAPPING MACHINE

RELATED APPLICATION

This application claims the priority benefit of Italian Pat. App. No. 102019000020730, filed on Nov. 11, 2019, which is fully incorporated by reference herein in its entirety.

FIELD OF THE INVENTION

The present invention relates to a capping machine equipped with a plurality of capping heads with roto-translation movement.

BACKGROUND ART

Capping machines comprise a plurality of capping heads which, in the case of screw caps or in certain capping modes, not only require a translation movement from the top downwards—so as to couple the cap with the neck of the container to be capped—but also a rotation movement.

Conventional capping machines may use, for this purpose, a motor connected to a nut screw on which a nut slides. The nut is then anchored to the capping element which is thus subjected to a roto-translation movement adapted to operate the desired capping. This system may be used if the rotation movements are controlled individually.

Another implementation may involve the use of a single motor for the rotation which, by means of the use of a belt, imparts the rotation to all the heads of the carousel. In this case, the torque control, to determine if the capping has been reached, is carried out by means of a preloaded clutch mounted on each individual head, which releases the rotation at the set tightening torque.

Such machines, however, although easily configured, have the disadvantage that, in the event of downtime of the machine and/or of the motor being uncoupled, and if the need arises to lift the capping head to allow the area below to be inspected, such lifting must overcome a very high torque, therefore it may be impossible to proceed with the simple movement of the hand or in some cases also due to the interference of a cam.

Roto-translating motors exist which are provided with high compactness and precision; although, such motors have the defect of including the rotor magnets inside the roto-translating shaft, which severely limits the space available for the various utilities, such as air, vacuum or even an ejector.

SUMMARY OF THE INVENTION

An object of the invention is a capping head comprising the technical features set out in one or more of the appended claims, the definitions of which form an integral part of the present description.

It is a further object of the invention a capping machine comprising a plurality of the capping heads in accordance with the invention.

Further features and advantages of the present invention will become more apparent from the following indicative and thus non-limiting description of a preferred, but not exclusive, embodiment of the invention.

DETAILED DESCRIPTION OF THE INVENTION

Figure 1:
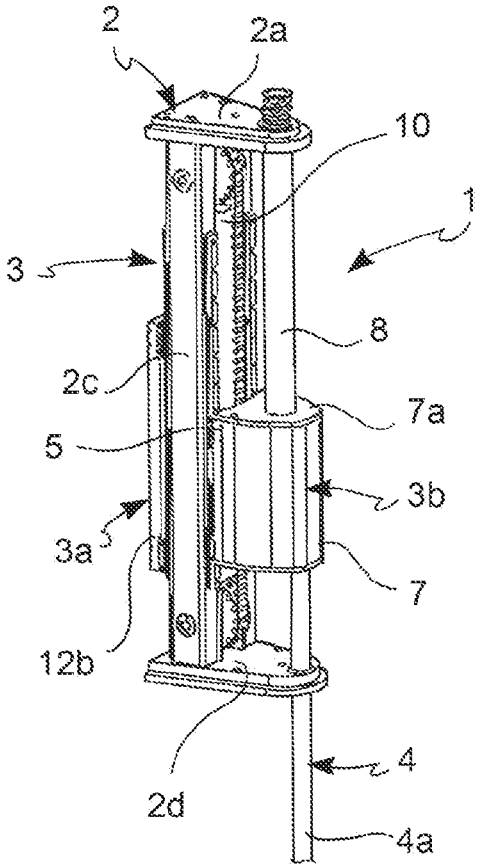
FIG. 1 shows a front perspective view of the capping head in accordance with an embodiment of the invention.
Figure 2:
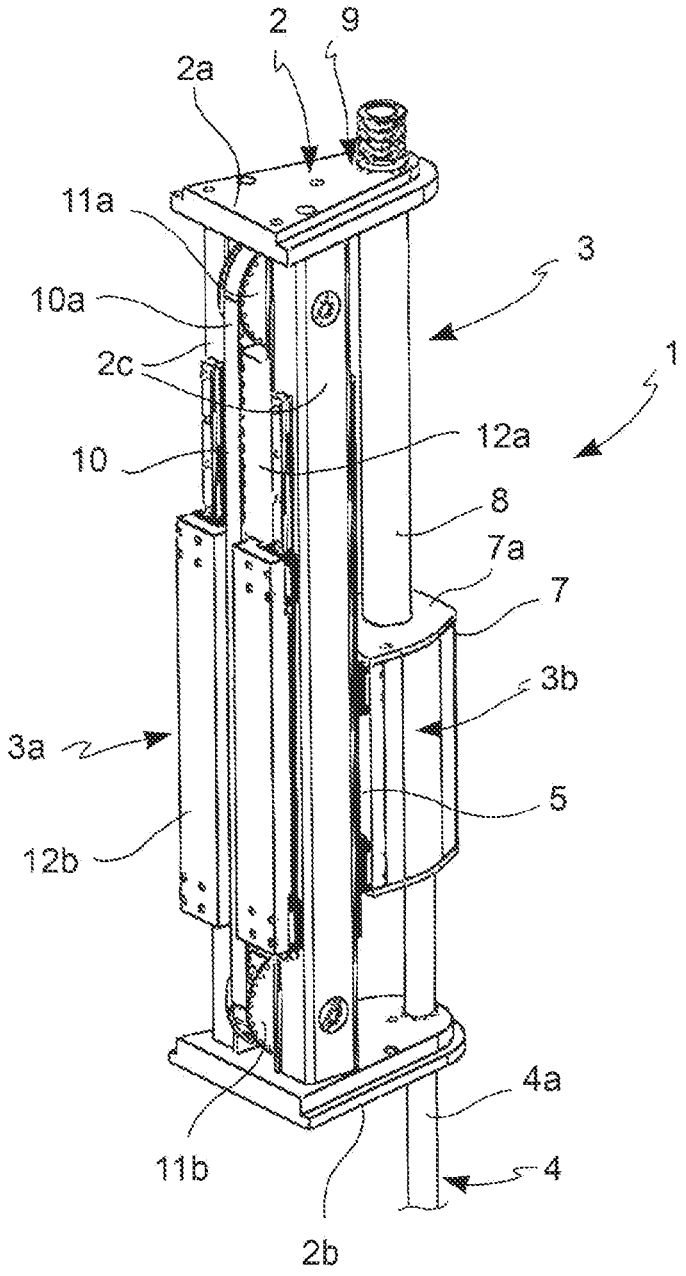
FIG. 2 shows a rear perspective view of the capping head of FIG. 1.
Figure 3:
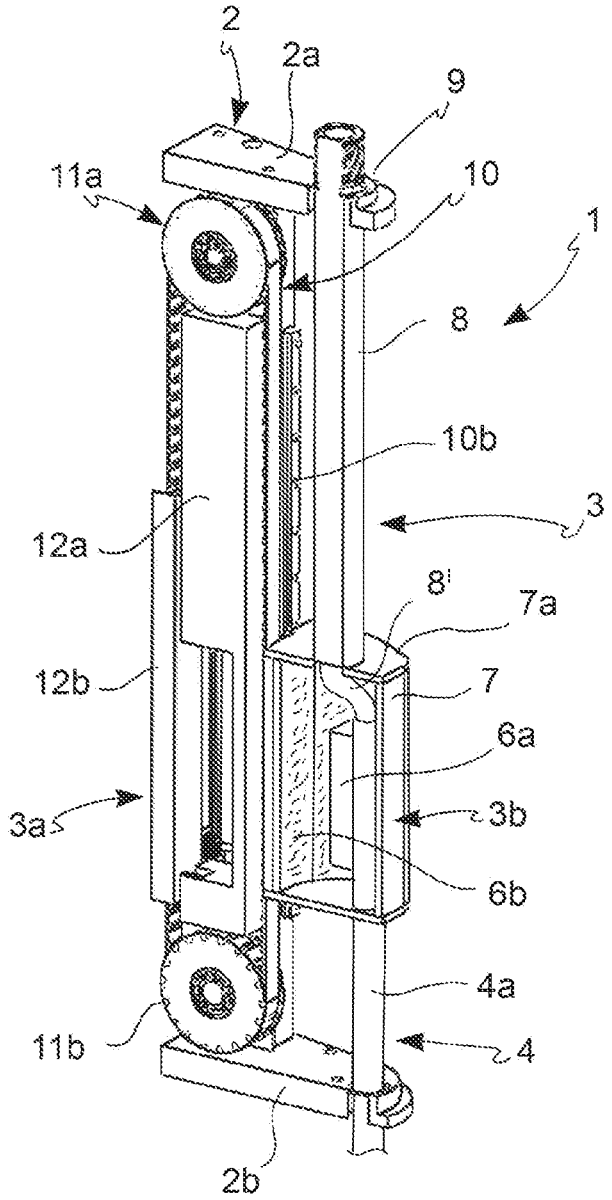
FIG. 3 shows a cut-away front perspective view of the capping head of FIG. 1.

FIGS. 1 to 3 show a first embodiment of the capping head of the invention. The capping head, indicated as a whole with reference numeral 1, comprises a supporting structure 2 on which a roto-translation system 3 for a capping device 4 is mounted.

Figure 4:
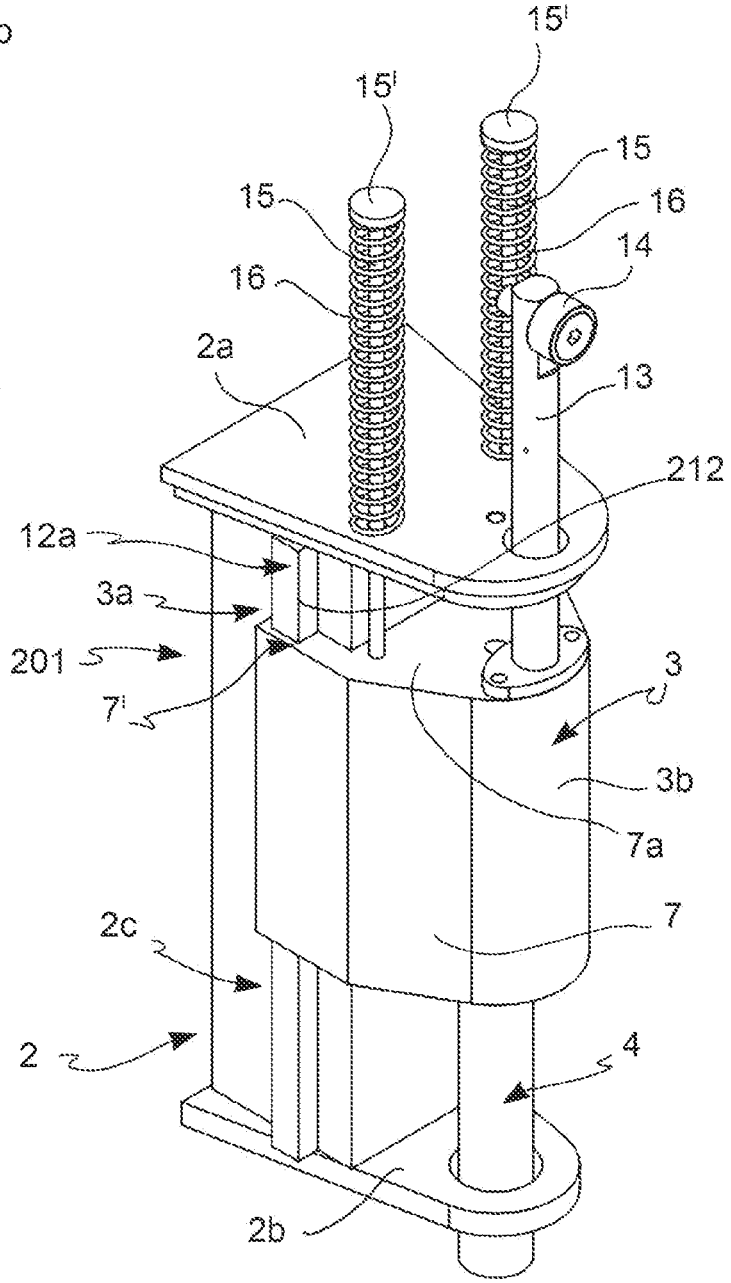
FIG. 4 shows a front perspective view of the capping head in accordance with a different embodiment of the invention.
Figure 5:
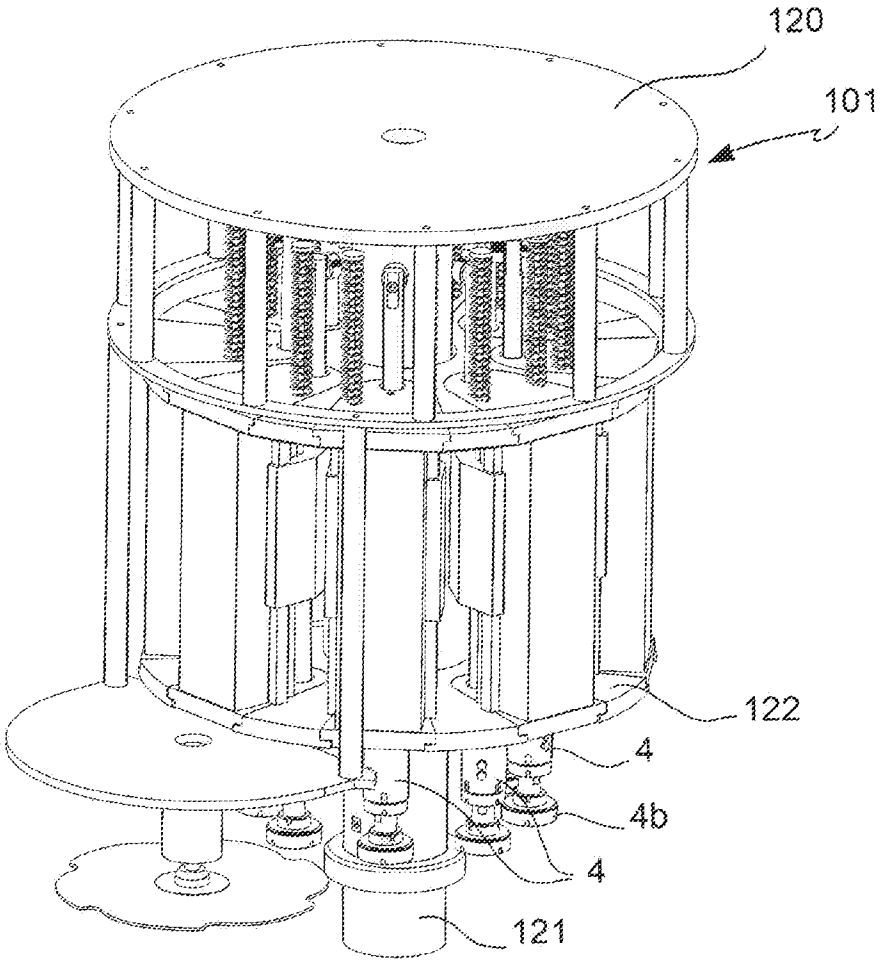
FIG. 5 shows a perspective view of a capping machine equipped with the capping heads of FIG. 4.
Figure 6:
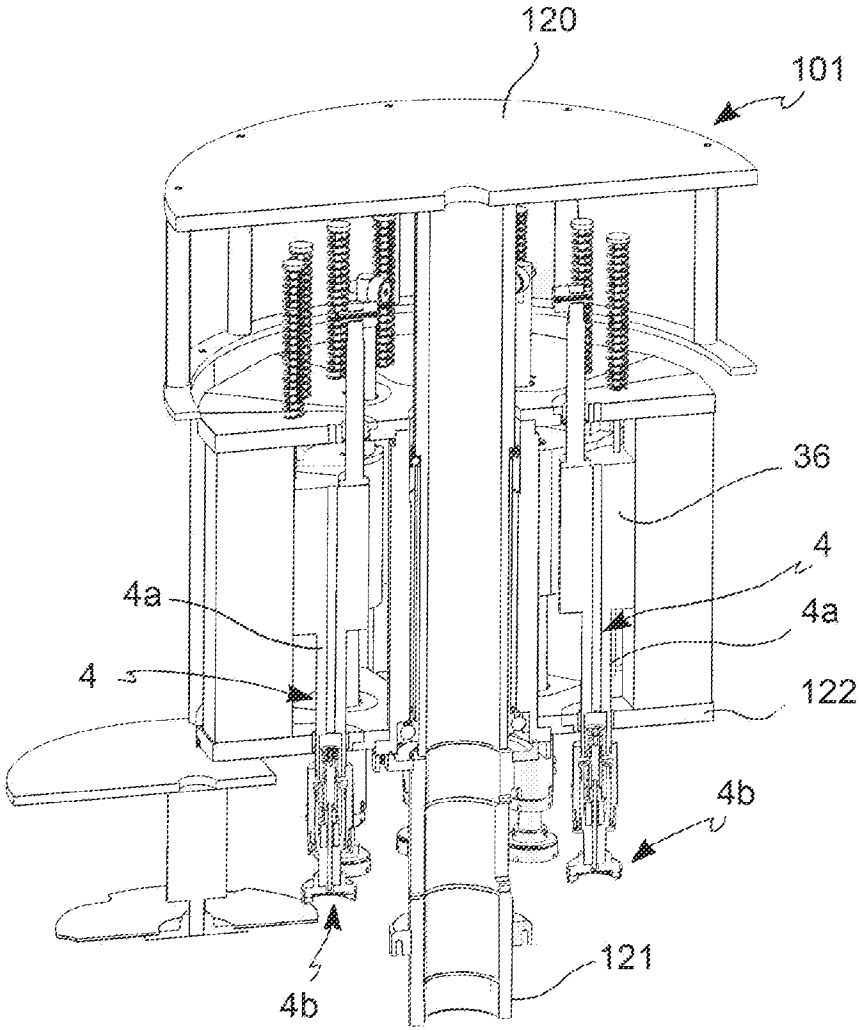
FIG. 6 shows a cut-away of the view of FIG. 5.

The capping device 4 is partially shown in FIGS. 1-4, but it may be seen in the entirety thereof in FIGS. 5 and 6. The capping device comprises a hollow rod 4*a* and a capping member 4*b* placed at the lower end of the rod 4*a*. The capping member 4*b* is of the conventional type and it may assume various shapes depending on the cap to be handled. The cavity of the rod 4*a* conventionally accommodates a utility which is useful or required during the capping operation, such as, for example, compressed air, sterile air, vacuum or an ejector for the cap.

The supporting structure 2 comprises an upper plate 2*a*, a lower plate 2*b* and one or more uprights 2*c* which connect said upper 2*a* and lower plates 2*b*. The supporting structure 2 will further comprise means for the fastening to a carousel 101 (shown in FIGS. 5 and 6), such as clamps, screw-nut screw systems and the like.

The roto-translation system 3 is placed between the two plates 2*a*, 2*b* and comprises a linear motor 3*a* and a rotary motor 3*b* operatively coupled so as to impart a roto-translation motion to the capping device 4.

The rotary motor 3*b* is preferably a brushless electric motor, more preferably a torque motor, of the conventional type and comprises a casing 7 which contains a rotor 6*a*, externally coupled to the capping device 4, and a stator 6*b*.

In certain embodiments, the casing 7 of the rotary motor 3*b* is connected to a pipeline 8 which provides the desired utility, such as air or vacuum, to the hollow rod 4*a* of the capping device 4 by means of a suitable junction 8'. The pipeline 8 is fastened to the casing 7 and slides upwards or downwards together with the rotary motor 3*b*. The sliding of the pipeline 8 occurs by means of a hole 9 arranged on the upper plate 2*a* of the supporting structure 2, which acts as a guide.

The rotary motor 3*b* further comprises a sliding portion 5 which is slidable on a guide vertically arranged on the uprights 2*c*, so as to allow the vertical sliding of the rotary motor 3*b*. The sliding portion 5 is coupled for a movement integral to a loop member 10, such as a belt, a toothed belt or a chain. The loop member 10 is in turn coupled with an upper pulley 11*a* and a lower pulley 11*b*, idly hinged on the uprights 2*c* of the supporting structure 2, and has a front side 10*b*, on which the sliding portion 5 of the rotary motor 3*b* is coupled, and a rear side 10*a*.

The linear motor 3*a* comprises a stator 12*a* and a movable member 12*b*. The stator 12*a* is fastened to the uprights 2*c* and longitudinally extends between the upper plate 2*a* and the lower plate 2*b*. The movable member 12*b* is instead fastened on the rear side 10*a* of the loop member 10, so that, when the rotary motor 3*b* is in a raised position, in which the capping device is disengaged from the neck of a container to be capped, the capping device 12*b* is in a lowered position, and vice versa.

This configuration allows to obtain a counterweight for the rotary motor 3*b*, so as to keep it in a raised position even when the linear motor 3*a* is in an error condition, whereby it is unable to control the movement of the rotary motor 3*b*.

A further advantage of this solution, in addition to the fact that the movable member of the linear motor is a counterweight for the torque motor, is that, by virtue thereof, the linear motor is balanced (as if it worked horizontally) and it is therefore possible to perform a torque sizing (therefore sizing dimensions and weight) much lower with respect to the case with the torque motor directly mounted on the movable member of the linear motor with the additional counterweight.

In the case where the weight of the movable member 12*b* is substantially different from that of the rotary motor 3*b*, it will be possible to provide a load on the movable member 12*b* or on the rotary motor, as appropriate.

Thereby, a suspension system is obtained which is adapted to keep the rotary motor 3*b* in a raised position even when the linear motor 3*a* is malfunctioning, for example, if the electromagnetic field fails or if an electromagnetic decoupling occurs between the stator and the movable member.

In a different embodiment, not shown in the Figures, the movable member 12*b* is fastened to the front side 10*b* of the loop member 10 and to the sliding portion 5 of the rotary motor 3*b*, while, on the rear side 10*a* of the loop member 10, the movable member 12*b* is replaced by a ballast of suitable weight so as to obtain said rotary motor suspension system 3*b*. Thereby, the movable member 12*b* of the linear motor 3*a* rises and lowers together with the rotary motor 3*b*, while the ballast provides the counterweight necessary to keep the rotary motor 3*b* together with the movable member 12*b* in a raised position even in the event of disengagement of the linear motor.

FIG. 4 shows a different embodiment of the invention.

The capping head 201 comprises, similarly to the embodiments described above, a supporting structure 2 on which a roto-translation system 3 for a capping device 4 is mounted.

The supporting structure 2 and the capping device 4 are entirely similar to those described above. The roto-translation system 3 in turn comprises a linear motor 3*a* and a rotary motor 3*b*, in which the rotary motor 3*b* and the movable member of the linear motor 3*a* are enclosed in the same casing 7, while the stator 12*a* of the linear motor 3*a* is fastened on one or more uprights 2*c* of the supporting structure 2. The casing 7 comprises a sliding portion 7' adapted to slide on a profile 212 of the stator 12*a*.

On the upper surface 7*a* of the casing 7 there is a rod 13 which passes through the upper plate 2*a* of the supporting structure 2 and ends with a wheel 14 adapted to slide on a cam (not shown), which acts as an emergency lifting means of the capping device 4, in the event that an inconvenience or malfunction occurs.

The embodiment of FIG. 4 comprises in turn a suspension system of the rotary motor 3*b* (integral with the movable member 12*b* of the linear motor 3*a*). Such suspension system consists of one or more bars 15 (in the Figures, two bars 15 are shown) which cross the upper plate 2*a* and end with a mushroom-shaped or T-shaped section 15'. Between the upper plate 2*a* and the mushroom-shaped or T-shaped section 15', a spring 16 is set, preloaded so as to keep the rotary motor 3*b* in a raised position.

Therefore, when, during the operating step of the capping head 201, it is necessary to bring the capping device 4 downwards, the linear motor 3*a* will act against the resistance operated by the springs 16. In case of error or disconnection of the linear motor 3*a*, the springs 16 will automatically return the rotary motor 3*b*—and therefore also the capping device 4—to a raised position.

In case of unbalance (movable member of the linear motor lighter than the torque motor), the balancing solution in case of intervention of the safety cam may be reached without ballasting the system (as described above), but simply by ensuring that the safety cam raises the torque motor to a level higher with respect to the normal working one, and by arranging a magnet above the motor so as to keep the motor in a raised position until the working conditions are restored. Upon restarting, the motor itself will disconnect the system from the safety magnet.

In such embodiment, therefore, the rotary motor 3*b* comprises, on the upper surface 7*a* of the casing 7, a safety magnet to keep the rotary motor 3*b*, following said emergency lifting, in a raised position.

FIG. 4, for simplicity of representation, does not show the pipeline 8 for dispensing air or vacuum above the casing 7, although, it must be understood that such pipeline 8 may also be present in this embodiment. Similarly, FIGS. 1-3 do not show the presence of the rod 13 and of the wheel 14 for the emergency cam, although, it must be understood that such lifting system may also be present in the embodiment of FIGS. 1-3.

FIGS. 5 and 6 show, instead, a capping machine comprising, by way of example, a plurality of capping heads 201 as shown in FIG. 4. It must be understood that a capping machine according to the invention may also mount the capping heads 1 described above and shown in relation to FIGS. 1-3.

The capping machine 101 is, per se, of the conventional type and comprises a carousel 120. The carousel 120 comprises a central axis 121, on which a discoidal plate 122 is integrally supported, on the edge of which the capping heads 1, 201 of the invention are installed. The capping devices 4 cross the discoidal plate 122 and are arranged on a support (not shown) which is coaxial with respect to the discoidal plate 122, on which the containers to be capped are held in rotation.

The central axis 121 of the carousel 120 is set in rotation by a motor drive (not shown).

The invention achieves the intended objects, as it allows to impart a roto-translation motion to the capping device 4, without the aid of worm screws, but by virtue of the coupling of a rotary motor with a linear motor.

At the same time, the technical solution adopted in the present invention allows to provide a suspension system for the motor drive unit, in particular for the rotary motor to which the capping device is associated, which allows the automatic or manual lifting of the capping device and the maintenance thereof in a raised position even in case of disconnection of the linear motor in charge of the vertical movement of the capping device itself.

An additional advantage is torque control. In a conventional roto-translating solution, the rotating member incorporates components which are used not only for the rotation, but also for the translation; thereby, the inertia of the rotor will be greater, and therefore it will be more difficult to achieve a control which accurately determines the tightening torque of the screw caps. In the invention, in which the translation has been decoupled from the rotation, the shaft of the rotary motor only comprises elements which are functional for the rotation, thereby it will have a lower inertia with respect to the conventional solution and therefore the tightening torque control will be easier to achieve, more precise and more effective.

Clearly, only a few particular embodiments of the present invention have been described, so a person skilled in the art will be able to make all of the necessary changes for the adaptation thereof to particular applications, without thereby departing from the scope of protection of the present invention. For instance, and by way of example only, it is understood that the appended claim 12 could recite a capping machine comprising a carousel on which a plurality of capping heads according to any one of claims 1-11 is mounted.

What we claim is:

1. A capping head comprising a supporting structure on which a roto-translation system is mounted, operatively connected to a capping device, wherein the roto-translation system comprises a linear motor and a rotary motor operatively coupled so as to impart a roto-translation motion to the capping device and wherein the capping head comprises a suspension system adapted to keep the rotary motor in a raised position even when the linear motor is disconnected or electromagnetically decoupled, wherein the supporting structure comprises an upper plate, a lower plate and one or more uprights which connect said upper and lower plates and wherein the linear motor comprises a stator and a movable member, wherein the stator is fastened to the one or more uprights and longitudinally extends between the upper plate and the lower plate, a sliding portion being coupled for a movement integral to a loop member, the loop member being in turn coupled with an upper pulley and a lower pulley, idly hinged on the one or more uprights of the supporting structure, wherein the loop member comprises a front side, on which the sliding portion of the rotary motor is coupled, and a rear side.

2. The capping head according to claim 1, wherein the capping device comprises a hollow rod and a capping member located at the lower end of the rod and wherein the hollow rod houses a service utility or tool therein.

3. The capping head according to claim 2, wherein the rotary motor comprises a casing that contains a rotor externally coupled to the rod of the capping device, and a stator.

4. The capping head according to claim 3, wherein the casing of the rotary motor is connected to a pipeline which provides the desired utility to the hollow rod of the capping device by means of a junction.

5. The capping head according to claim 1, wherein the casing comprises a sliding portion slidable on a guide vertically arranged on the one or more uprights or on a profile, so as to allow the vertical sliding of the rotary motor.

6. The capping head according to claim 1, wherein the loop member is selected from a belt, a toothed belt or a chain.

7. The capping head according to claim 1, wherein the movable member is fastened on the rear side of the loop member, so that, when the rotary motor is in a raised position, the movable member is in a lowered position, and vice versa, wherein the movable member acts as a counterweight for the rotary motor so as to provide a rotary motor suspension system.

8. The capping head according to claim 1, wherein the movable member is fastened to the front side of the loop member and to the sliding portion of the rotary motor, and wherein a ballast of suitable weight is fastened to the rear side of the loop member so as to obtain said rotary motor suspension system.

9. The capping head according to claim 1, wherein the suspension system consists of one or more bars ending with a mushroom-shaped or T-shaped section, a spring being set between the upper plate and the mushroom-shaped or T-shaped section, the spring being preloaded so as to keep the rotary motor in a raised position when the linear motor is disconnected, electromagnetically decoupled or malfunctioning.

10. The capping head according to claim 1, wherein the roto-translation system comprises a rod which ends with a wheel adapted to run on a cam, which acts as an emergency lifting means of the capping device.

11. The capping head according to claim 10, wherein the rotary motor comprises, on the upper surface of the casing, a safety magnet to keep the rotary motor, following said emergency lifting, in a raised position.

12. A capping machine comprising a carousel on which a plurality of capping heads according to claim 1 is mounted.

* * * * *